United States Patent [19]

Sandgren

[11] Patent Number: 4,638,757

[45] Date of Patent: Jan. 27, 1987

[54] APPARATUS FOR SPREADING JOINTING ADHESIVE ON A PAPER WEB WHICH MAKE ONE SIDE OF A FORM ENVELOPE

[75] Inventor: Lasse Sandgren, Kerava, Finland

[73] Assignee: Oplatek Oy, Leppavirta, Finland

[21] Appl. No.: 756,154

[22] PCT Filed: Oct. 19, 1984

[86] PCT No.: PCT/FI84/00077

§ 371 Date: Jun. 19, 1985

§ 102(e) Date: Jun. 19, 1985

[87] PCT Pub. No.: WO85/01700

PCT Pub. Date: Apr. 25, 1985

[30] Foreign Application Priority Data

Oct. 21, 1983 [FI] Finland ..... 833851

[51] Int. Cl.[4] ..... B05C 5/02

[52] U.S. Cl. ..... 118/411; 156/291

[58] Field of Search ..... 118/411, 212, 412; 156/291

[56] References Cited

U.S. PATENT DOCUMENTS 3,034,476 5/1962 Didde et al. ..... 118/711

4,249,984 2/1981 Vermehren ..... 118/212 X 4,295,445 10/1981 Kopenhauer ..... 118/212 X 4,332,212 6/1982 Jesme ..... 118/411 X

*Primary Examiner*—John P. McIntosh

*Attorney, Agent, or Firm*—Neuman, Williams, Anderson & Olson

[57] ABSTRACT

An apparatus for spreading jointing adhesive on each side of a crosswise tear-off perforation on a paper web which makes one side of form envelopes, said apparatus comprising an adhesive spreading roll (2, 2'') and a counter roll (6) for passing therebetween said paper web (7) with crosswise tear-off perforations. The periphery of adhesive spreading roll (2) is provided with two parallel arrays of adhesive nozzles (**2*a*) extending longitudinally of the roll. In order to adapt the apparatus to forms of various sizes (to perforation gaps of various lengths), the distance of nozzle arrays (2*a*) from the center axis of rotation (3) of gluing roll (2) is adapted to be varied either in a manner that there are used several replaceable adhesive spreading rolls (2) having different diameters or in a manner that several nozzle rails (2*b*, 2*c*) having different heights can be replaced and fitted in a groove (2*d*) provided on roll (2'**).

9 Claims, 4 Drawing Figures

APPARATUS FOR SPREADING JOINTING ADHESIVE ON A PAPER WEB WHICH MAKE ONE SIDE OF A FORM ENVELOPE

The present invention relates to an apparatus for spreading jointing adhesive on both sides of a crosswise tear-off perforation in a paper web which makes one side of form envelopes, said apparatus comprising a glue or adhesive spreading roll and a counter roll for passing therebetween said paper web with crosswise tear-off perforations.

The generalization of computerized billing has led to the development of invoice forms which are sealed between two continuous paper webs in a manner that the forms, together with their envelopes, can be later detached from each other at crosswise tear-off perforations. In the preparation of such forms and their envelopes, the forms are set upon a paper web making one side of the envelope between the perforations, and a paper web making the other side of the envelope is passed through a jointing adhesive spreading device, in which jointing adhesive is spread or applied on each side of a perforation, the paper webs being placed against each other so as to bring the perforations in alignment with each other whereby the ends of said envelopes on each side of the perforations will be glued to each other. Also the sides of paper webs are conventionally glued to each other but this procedure involves no problems. On the other hand, spreading of jointing adhesive on each side of a perforation requires extremely high accuracy since, even after the sides of the envelopes have been glued to each other, the adhesive material must not spread to a perforation nor extend to the edge of a form itself so that the form can be pulled out of the envelope. The space between a perforation and a form edge must be kept as narrow as possible so that the lengths of a form and envelope do not unreasonably differ from each other. Both the dosage and positioning of the amount of adhesive must be done most accurately. This requirement is not sufficiently met with available adhesive spreading equipment, designed for this purpose, their particular defect being that such adhesive spreading principle limits the equipment's productive capac- ity.

An object of the invention is to provide for the above purpose such an adhesive spreading apparatus that can be worked at a high rate of production and at high accuracy.

This object is achieved by an apparatus of the invention on the basis of the characterizing features set out in the annexed claims.

One embodiment of the invention will now be described in more detail with reference made to the accompanying drawings, in which FIG. 1 is a side view of an apparatus of the invention.

The apparatus comprises on each side thereof vertical frame plates 1, mounted at a distance (orthogonal to the plane of drawing) from each other. Extending between frame plates 1 are an adhesive spreading roll 2 and a counter roll 6, a paper web 7 for making one side of form envelopes being passed around the latter. Web 7 is provided with crosswise tear-off perforations at set intervals, corresponding to the length (or width) of a form envelope to be produced. On each side of these tear-off perforation lines as close to perforation as possible must be spread jointing adhesive which must not spread to perforation when the web will later be glued upon a paper web which makes the other side of an envelope. A chain of finishing envelopes, with the forms sealed therein, must be such that it can later be separated along perforation lines into separate envelopes after running said chain of envelopes through a computer printer, which through an envelope prints necessary date on the forms and address information on the envelope.

Figure 2:
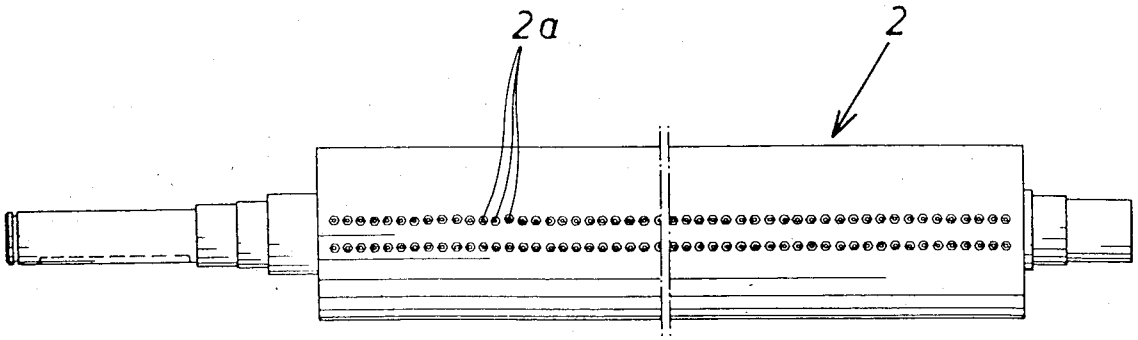
FIG. 2 shows an adhesive spreading roll for said apparatus.
Figure 3:
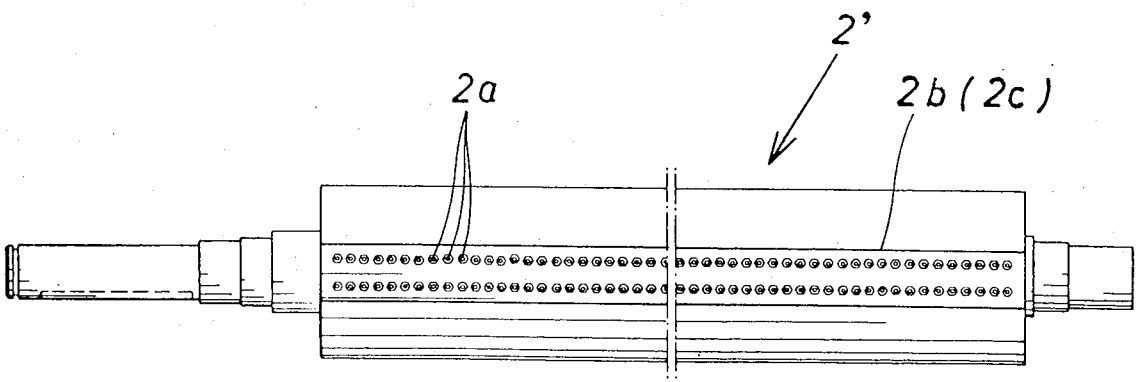
FIGS. 3 and 4 show another embodiment of an adhesive spreading roll.

For this spreading or application of jointing adhesive, said adhesive spreading roll 2 is fitted with two parallel, lengthwise of the roll extending arrays of glue nozzles 2a (FIGS. 2 and 3). Glue or adhesive can be passed into nozzles 2a, as set forth in e.g. FI Patent application No. 830385. Another alternative is to build inside a roll 2 a common adhesive chamber, communicating with all nozzles 2a. Adhesive is led into roll 2 through a rotating connector at the end of said roll. Also the design of said nozzles can be the same as set forth in FI Patent application No. 830385.

The bearing support 8 of said counter roll 6 is mounted on frame 1 by means of an eccentric sleeve 10 which is turnable relative to the frame. When turning said bearing 8, also sleeve 10 turns along and thus the rotational axis 9 of roll 6, which is not the same as the turning axis of eccentric sleeve 10, shifts relative to frame 1. Said bearing support 8 is fitted with a cog 11 leaning against a cam 12, the latter being mounted on a shaft turnable on frame plates 1. By turning cam 12 the position of rotational axis 9 of counter roll 6 can be adjusted relative to frame 1 with high accuracy.

In addition, said counter roll 6 must be capable of being disengaged from working contact with adhesive nozzles 2a of said adhesive spreading roll 2. For this purpose, the cog 11 of bearing support 8 is contacted by a pneumatic cylinder 13 on one hand for pressing cog 11 against cam 12 and on the other hand for drawing it away from it in order to bring said counter roll 6 respectively to on- and off-position.

A drive shaft 14 is synchronized with the driving speed of paper web 7 and provided with a cogged belt drive 19, 23 to counter roll 6. This cogged belt drive 19, 23 is passed via a control device 20, comprising two concentric belt pulleys 21 and 22 whose relative angle of roll is adjustable and lockable in a desired position.

The ends of counter roll 6 and adhesive spreading roll 2 are fitted with meshing cogged wheels which ensure that rolls 2 and 6 are driven at the same peripheral speed, which in the adhesive spreading roll is determined according to the periphery extending via nozzle jets 2a.

The control or adjustment device 20 serves to set the relative position of paper web 7 and rolls 6, 2 in a manner that the parallel arrays of adhesive nozzles 2a fall accurately on each side of the perforation of web 7. Thus, the distance between successive perforations must accurately match the length of that periphery which extends around adhesive spreading roll 2 between the arrays of nozzles 2a. The periphery of adhesive spreading roll 2 can be provided with one or more pairs of nozzle arrays.

An essential feature of the invention is that the apparatus can be readily adapted to form envelopes of varying sizes, in other words to varying perforation gaps on paper web 7.

Figure 1:
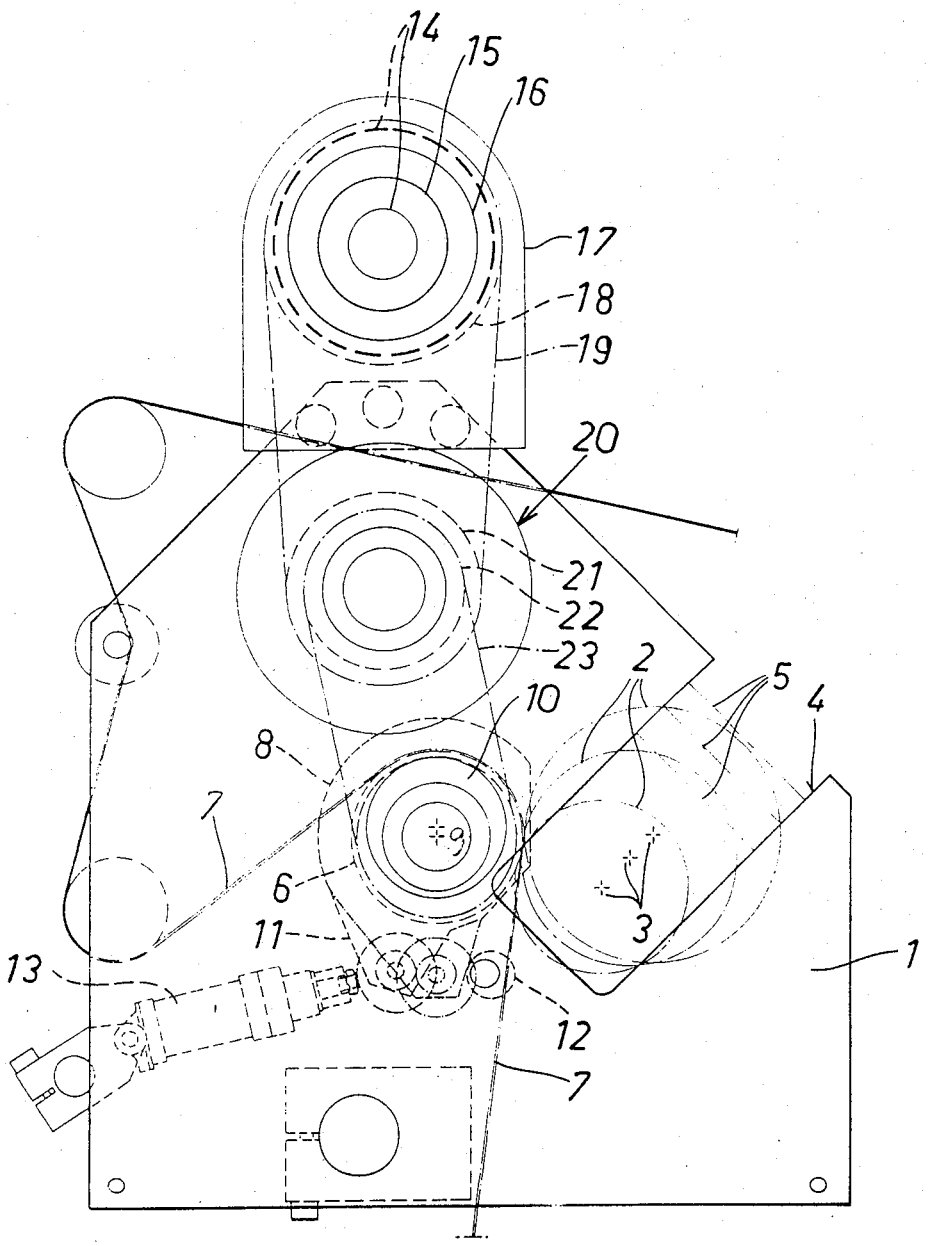

In FIG. 1, the dash-and-dot lines illustrate several adhesive spreading rolls 2 of different diameters, the position of whose rotational axes changes according to the change in roll diameter. In order to still maintain the carefully adjusted working contact of a paper web running on top of the nozzles of adhesive spreading roll 2 and counter roll 6 (or at least to stay within the accurately adjustable setting range of the apparatus), said frame plates 1 are provided with special recesses 4 for receiving the bearing supports 5 of roll 2. The mutually parallel side edges of recesses 4 make an obtuse angle with the line connecting the center axes of rotation 3 and 9 of rolls 2 and 6. When each adhesive spreading roll 2 having a different diameter has been secured in recesses 4 by means of bearing supports of suitable height, the proper working contact of rolls 2 and 6 can be maintained. Simultaneously maintained is the meshing of drive gears mounted on the ends of rolls 2 and 6 since, as the diameter of an adhesive spreading roll changes, the diameter of the rolling circle of a gear or cogged wheel at the end of a roll must change accordingly.

Figure 4:
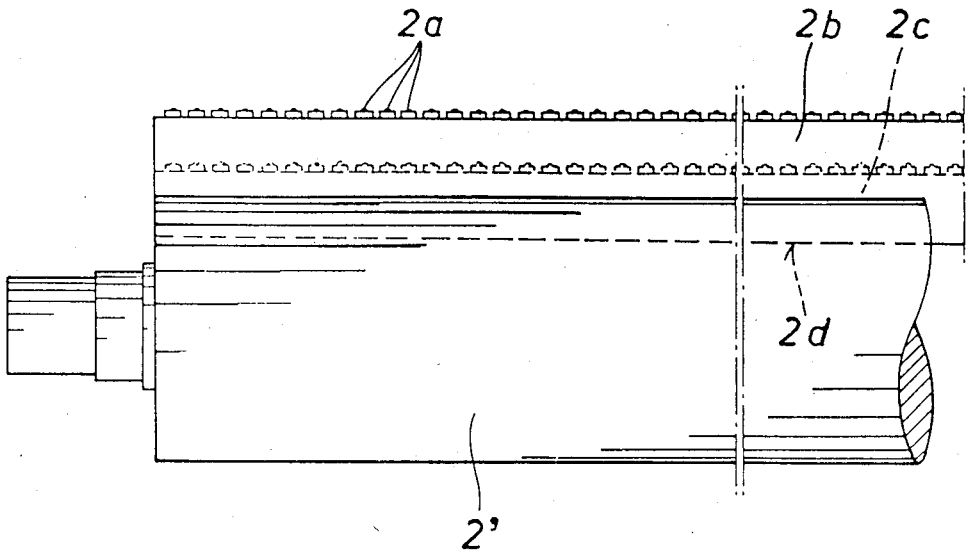

As pointed out above, the operating periphery of adhesive spreading roll 2 is the imaginary periphery which extends via the ends of nozzles 2*a* and whose center axis is the same as the axis of rotation 3 of roll 2. Hence, it won't be necessary to replace the entire roll as the perforation gap changes, but the same roll can be provided with nozzle rails of different height. This embodiment is illustrated in FIGS. 3 and 4. A groove 2*d* in roll 2' can be fitted with a higher nozzle rail 2*b* or a lower nozzle rail 2*c*. Also in this embodiment it is possible to use one or more nozzle rails or bars on the periphery of roll 2'. Thus, proceeding to a half size smaller form can be done by leaving out one of the two nozzle rails mounted on opposite sides of the roll.

FIG. 1 shows a support plate 17 mounted on the upper edge of frame plate 1, said drive shaft 14 being journalled to that support plate by means of a bearing 15 in a bearing support sleeve 16. The means for pulling web 7 are not shown but are synchronized with the rotating speed of drive shaft 14 by means of mechanical coupling.

The accurate control of the contact pressure of adhesive nozzles 2*a* is important e.g. for the reason that a sufficiently small amount of adhesive can thus be metered, so that the adhesive won't spread during the following step of gluing paper webs to each other.

I claim:

1. In an apparatus for applying jointing adhesive to opposite sides of transverse perforations defining tear lines on a paper web, the combination comprising a rotatably mounted adhesive spreading roll; a rotatable counter roll oppositely disposed to said adhesive spreading roll; means for passing a paper web having transverse perforations at regular longitudinal intervals between said adhesive spreading roll and said counter roll; said adhesive spreading roll having two parallel arrays of adhesive dispensing nozzles with adhesive dispensing distal ends extending lengthwise of said adhesive spreading roll for applying adhesive at regular longitudinal intervals to a paper web; means for supplying adhesive under pressure to said nozzles; and means for altering the radial distance between the adhesive dispensing nozzle distal ends and the axis of rotation of an adhesive spreading roll in said apparatus whereby the interval between the application of adhesive to a paper web by said parallel arrays of adhesive dispensing nozzles is altered.

2. The apparatus of claim 1 in which the interval altering means comprise a plurality of parallel arrays of nozzles of different height detachably mountable on an adhesive spreading roll.

3. The apparatus of claim 1 in which the interval altering means comprise a plurality of adhesive spreading rolls of varying diameter on which arrays of adhesive dispensing nozzles are mounted.

4. The apparatus of claim 1 in combination with opposed side plates; bearings for said adhesive spreading roll mounted in recesses in said side plates whereby said latter roll is transversely disposed to said side plates; said recesses being so located relative to the axis of said counter roll that the interval between said adhesive spreading roll and the counter roll may be adjusted.

5. The apparatus as set forth in claim 4 in combination with eccentric bearing means for said counter roll mounted in said side plates; and cam means for rotating said eccentric bearing means and altering the location of the axis of rotation of said counter roll between said side plates and relative to said adhesive spreading roll.

6. The apparatus of claim 5 in which a cam follower is connected to said eccentric bearing means which engages said cam means, and is in combination with actuating means for actuating said cam means to alternately pivot the axis of rotation of said counter roll toward and away from said adhesive spreading roll.

7. The apparatus of claims 1, 2, 3, 4, 5, or 6 in combination with means for rotatably driving said adhesive spreading roll and said counter roll at the same peripheral speed; the periphery of said adhesive spreading roll being defined by the periphery formed by the nozzle distal ends in the course of rotation.

8. The apparatus of claim 7 in which the ends of the counter roll and adhesive spreading roll are provided with interengaging means such as meshing gears or the like.

9. The apparatus of claim 8 in combination with a drive shaft rotating synchronously with the speed of the paper web and which is provided with a belt drive for said counter roll; and speed-changing means interconnecting said drive shaft and said counter roll; said speed-changing means comprising adjustable pulley means.

* * * * *